US010815998B2

(12) United States Patent
Kim et al.

(10) Patent No.: US 10,815,998 B2
(45) Date of Patent: Oct. 27, 2020

(54) SCROLL COMPRESSOR HAVING A CAPACITY VARIABLE DEVICE

(71) Applicant: LG ELECTRONICS INC., Seoul (KR)

(72) Inventors: Minjae Kim, Seoul (KR); Sungsoon Jang, Seoul (KR); Seongjo Kim, Seoul (KR); Jeongwoo Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 365 days.

(21) Appl. No.: 15/856,548

(22) Filed: Dec. 28, 2017

(65) Prior Publication Data

US 2018/0187682 A1 Jul. 5, 2018

(30) Foreign Application Priority Data

Jan. 3, 2017 (KR) ..... 10-2017-0000853

(51) Int. Cl.

| | |
|---|---|
| ***F04C 28/26*** | (2006.01) |
| ***F04C 18/02*** | (2006.01) |
| ***F04C 28/10*** | (2006.01) |
| ***F04C 23/00*** | (2006.01) |
| ***F04C 29/12*** | (2006.01) |
| ***F04C 27/00*** | (2006.01) |

(52) U.S. Cl.

CPC ..... *F04C 28/26* (2013.01); *F04C 18/0215* (2013.01); *F04C 18/0253* (2013.01); *F04C 23/008* (2013.01); *F04C 27/005* (2013.01); *F04C 28/10* (2013.01); *F04C 29/128* (2013.01); *F04C 2270/205* (2013.01)

(58) Field of Classification Search

CPC .. F04C 28/26; F04C 18/0215; F04C 18/0253; F04C 28/10; F04C 28/265; F04C 23/008

See application file for complete search history.

(56) References Cited

U.S. PATENT DOCUMENTS

| | | | |
|---|---|---|---|
| 5,336,058 | A | 8/1994 | Yokoyama |
| 5,649,816 | A | 7/1997 | Wallis et al. |

(Continued)

FOREIGN PATENT DOCUMENTS

| | | | |
|---|---|---|---|
| CN | 2219979 | Y | 2/1996 |
| CN | 1592048 | A | 3/2005 |

(Continued)

*Primary Examiner* — Deming Wan

(74) *Attorney, Agent, or Firm* — Dentons US LLP

(57) ABSTRACT

A scroll compressor with a first valve having a first surface to open/close between a first path and a second path; a back pressure chamber assembly or non-orbiting scroll having a third path through which a first pressure refrigerant flows, a fourth path through which refrigerant of a second pressure lower than the first pressure flows, and one end in communication with the third and fourth paths and the other end having a fifth path in communication with a second surface of the first valve; and a second valve provided where the third, fourth, and fifth paths meet and moveable between first and second positions, wherein at the first position the third and fifth paths communicate to supply the first pressure refrigerant toward the second surface, and at the second position the fourth and fifth paths communicate to supply the second pressure refrigerant toward the second surface.

19 Claims, 8 Drawing Sheets

(56) References Cited

U.S. PATENT DOCUMENTS

| | | | | |
|---|---|---|---|---|
| 8,628,316 | B2 * | 1/2014 | Stover | F04C 28/265 417/299 |
| 2010/0254841 | A1 | 10/2010 | Akei et al. | |
| 2014/0064999 | A1 * | 3/2014 | Magadum | F04C 28/265 418/55.4 |

FOREIGN PATENT DOCUMENTS

| | | | |
|---|---|---|---|
| CN | 102089525 | A | 6/2011 |
| CN | 102422024 | A | 4/2012 |
| CN | 103032619 | A | 4/2013 |
| CN | 103671105 | A | 3/2014 |
| CN | 104196725 | A | 12/2014 |
| EP | 1025403 | B1 | 1/2006 |
| JP | 5-231353 | A | 9/1993 |

* cited by examiner

SCROLL COMPRESSOR HAVING A CAPACITY VARIABLE DEVICE

CROSS-REFERENCE TO RELATED APPLICATIONS

The present disclosure relates to subject matter contained in priority Korean Application No. 10-2017-0000853, filed on Jan. 3, 2017, which is herein expressly incorporated by reference in its entirety.

BACKGROUND OF THE INVENTION

1. Field of the Invention

The present disclosure relates to a scroll compressor, and more particularly, to a scroll compressor provided with a capacity variable device.

2. Description of the Related Art

Scroll compressor is a compressor in which a non-orbiting scroll is provided in an inner space of a casing to form a pair of two compression chambers formed with a suction chamber, an intermediate pressure chamber, and a discharge chamber between a non-orbiting wrap of the non-orbiting scroll and an orbiting wrap of an orbiting scroll while the orbiting scroll is engaged with the non-orbiting scroll to perform an orbiting motion.

The scroll compressor is widely used for compressing refrigerant in an air conditioner or the like since it has an advantage capable of obtaining a relatively high compression ratio as compared with other types of compressors, and obtaining a stable torque due to suction, compression, and discharge strokes of the refrigerant being smoothly carried out.

The scroll compressor may be divided into a high pressure type and a low pressure type depending on how refrigerant is supplied to the compression chamber. In a high pressure scroll compressor, refrigerant is sucked directly into the suction chamber without passing through the inner space of the casing, and discharged through the inner space of the casing, and most of the inner space of the casing forms a discharge space which is a high pressure portion. On the other hand, in a low pressure scroll compressor, refrigerant is indirectly sucked into the suction chamber through the inner space of the casing, and the inner space of the casing is divided into a suction space which is a low pressure portion and a discharge space which is a high pressure portion.

FIG. 1 is a longitudinal cross-sectional view illustrating a low pressure scroll compressor in the related art.

As illustrated in the drawing, a low pressure scroll compressor is provided with a drive motor 20 for generating a rotational force in an inner space 11 of a closed casing 10, and a main frame 30 are provided at an upper side of the drive motor 20.

On an upper surface of the main frame 30, an orbiting scroll 40 is orbitably supported by an Oldham ring (not shown), and a non-orbiting scroll 50 is engaged with an upper side of the orbiting scroll 40, and provided to form a compression chamber (P).

A rotation shaft 25 is coupled to a rotor 22 of the drive motor 20 and the orbiting scroll 40 is eccentrically engaged with the rotation shaft 25, and the non-orbiting scroll 50 is coupled to the main frame 30 in a rotationally constrained manner.

A back pressure chamber assembly 60 for preventing the non-orbiting scroll 50 being floated by a pressure of the compression chamber (P) during operation is coupled to an upper side of the non-orbiting scroll 50. The back pressure chamber assembly 60 is formed with a back pressure chamber 60*a* filled with refrigerant at an intermediate pressure.

A high-low pressure separation plate 15 for separating the inner space 11 of the casing 10 into a suction space 11 as a low pressure portion and a discharge space 12 as a high pressure portion while at the same time supporting a rear side of the back pressure chamber assembly 60 is provided at an upper side of the back pressure chamber assembly 60.

An outer circumferential surface of the high-low pressure separation plate 15 is closely adhered, welded to and coupled to an inner circumferential surface of the casing 10, and a discharge hole 15*a* communicating with a discharge port 54 of the non-orbiting scroll 50 is formed at a central portion thereof.

In the drawing, reference numerals 13, 14, 18, 21, 21*a*, 41, 42, 51, 52, 53 and 61 denote a suction pipe 13, a discharge pipe 14, a subframe 18, a stator 21, a winding coil 21*a*, an end plate portion 41 of an orbiting scroll 40, an orbiting wrap 42, an end plate portion 51 of a non-orbiting scroll 50, a non-orbiting wrap 52, a suction port 53, and a modulation ring 61 for variable capacity.

According to the foregoing scroll compressor in the related art, when power is applied to the drive motor 20 to generate a rotational force, the rotation shaft 25 transmits the rotational force of the drive motor 20 to the orbiting scroll 40.

Then, the orbiting scroll 40 forms a pair of two compression chambers (P) between the orbiting scroll 40 and the non-orbiting scroll 50 while performing an orbiting motion with respect to the non-orbiting scroll 50 by the Oldham ring to suck, compress, and discharge refrigerant.

At this time, part of the refrigerant compressed in the compression chamber (P) moves from the intermediate pressure chamber to the back pressure chamber 60*a* through a back pressure hole (not shown), and refrigerant at an intermediate pressure flowing into the back pressure chamber 60*a* generates a back pressure to float a floating plate 65 constituting the back pressure chamber assembly 60. The floating plate 65 is brought into close contact with a lower surface of the high-low pressure separation plate 15 to allow a back pressure chamber pressure to push the non-orbiting scroll 50 to the orbiting scroll 40 while at the same time separating the suction space 11 and the discharge space 12 from each other, thereby allowing the compression chamber (P) between the non-orbiting scroll 50 and the orbiting scroll 40 to maintain airtight seal.

Here, similarly to other compressors, the scroll compressor may vary a compression capacity in accordance with the demand of a freezing apparatus to which the compressor is applied. For example, as illustrated in FIG. 1, a modulation ring 61 and a lift ring 62 are additionally provided at an end plate portion 51 of non-orbiting scroll 50, and a control valve 63 being communicated by the back pressure chamber 60*a* and a first communication path 61*a* is provided at one side of the modulation ring 61. Furthermore, a second communication path 61*b* is formed between the modulation ring 61 and the lift ring 62, and a third communication path 61*c* being open when the modulation ring 61 floats is formed between the modulation ring 61 and the non-orbiting scroll 50. One end of the third communication path 61*c* communicates with the intermediate pressure chamber (P) and the other end thereof communicates with the suction space 11 of the casing 10.

In such a scroll compressor, during power operation, the control valve 63 closes the first communication path 61*a* and allows the second communication path 61*b* to communicate with the suction space 11 as illustrated in FIG. 2A, thereby maintaining the third communication path 61*c* in a closed state.

On the other hand, during saving operation, as illustrated in FIG. 2B, the control valve 63 allows the first communication path 61*a* to communicate with the second communication path 61*b*, thereby reducing compressor capacity while part of refrigerant in the intermediate pressure chamber (P) leaks into the suction space 11 as well as the modulation ring 61 floats to open the third communication path 61*c*.

However, a capacity variable device of the foregoing scroll compressor in the related art includes the modulation ring 61, the lift ring 62 and the control valve 63 and has a large number of components, and moreover, the first communication passage 61*a*, second communication passage 61*b* and third communication passage 61*c* must be formed on the modulation ring 61 to operate the modulation ring 61, thereby causing a problem in which the structure of the modulation ring 61 is complicated.

Furthermore, in a capacitor variable device of the scroll compressor in the related art, though the modulating ring 61 should be rapidly floated using the refrigerant of the back pressure chamber 60*a*, the modulation is formed in an annular shape and the control valve 63 is engaged with the coupling ring 61, and thus a weight of the modulation ring 61 increases, thereby causing a problem in rapidly floating the modulation ring.

In addition, in a capacity variable device of the scroll compressor in the related art, though a flow path for floating the modulation ring 61 is long and refrigerant should be introduced into a space between the modulation ring 61 and the lift ring 62 to float the modulation ring 61, a pressure of the back pressure chamber 60*a* still exists on an upper surface of the modulation ring 61, and thus it is not easy to float the modulation ring 61 and the responsiveness of the valve is reduced accordingly, thereby causing a problem that a capacity change of the compressor cannot be quickly controlled.

Moreover, a capacity variable device of the scroll compressor in the related art may not be structurally provided with a bypass hole and a check valve for opening and closing the bypass hole not to respond over-compression in the relevant operation mode, thereby reducing the efficiency of the compressor.

SUMMARY OF THE INVENTION

An object of the present disclosure is to provide a scroll compressor capable of simplifying the structure of the capacity variable device to reduce manufacturing cost.

Another object of the present disclosure is to provide a scroll compressor capable of alleviating restriction on parts constituting the capacity variable device.

Still another object of the present disclosure is to provide a scroll compressor capable of easily supplying power for operating the capacity variable device.

Yet still another object of the present disclosure is to provide a scroll compressor capable of simplifying the control of the capacity variable device to enhance the responsiveness.

Still yet another object of the present disclosure is to provide a scroll compressor in which a bypass hole for preventing over-compression and a valve for opening and closing the bypass hole are installed to prevent the efficiency of the compressor due to over-compression from being reduced.

In order to achieve the objectives of the present disclosure, there is provided a scroll compressor having a high-low pressure separation plate for separating an inner space of a casing into a high pressure portion and a low pressure portion, wherein a flow path communicating with an intermediate pressure chamber is formed between a non-orbiting scroll and a back pressure chamber assembly, and a valve capable of opening and closing the flow path is provided at an end portion of the flow path.

Here, the scroll compressor may further include a check valve provided in the middle of the flow path to be open or closed according to a pressure difference of the intermediate pressure chamber.

Furthermore, a plurality of the flow paths may be formed therein, and the plurality of flow paths may be formed to communicate with each other, and the control valve may be provided at an end portion of the flow path communicating with the low pressure portion.

In addition, in order to accomplish the objectives of the present disclosure, there is provided a scroll compressor, including a casing; an orbiting scroll provided with an orbiting wrap provided in an inner space of the casing to perform an orbiting motion; a non-orbiting scroll provided with a non-orbiting wrap provided at a first side thereof to form a compression chamber composed of a suction chamber, an intermediate pressure chamber, and a discharge chamber in engagement with the orbiting wrap; a back pressure chamber assembly provided at a second side of the non-orbiting scroll to form a back pressure chamber for pressurizing the non-orbiting scroll toward the orbiting scroll direction; a first flow path communicating from the intermediate pressure chamber to an outside of the intermediate pressure chamber; a second flow path communicating between the first flow path and an inner space of the casing; a first valve provided with a first surface to open and close between the first flow path and the second flow path; a third flow passage provided in the back pressure chamber assembly or the non-orbiting scroll to flow refrigerant at a first pressure; a fourth flow path provided in the back pressure chamber assembly or the non-orbiting scroll to flow refrigerant of a second pressure lower than the first pressure; a fifth flow path provided in the back pressure chamber assembly or the non-orbiting scroll, one end of which communicates with the third flow path and the fourth flow path, and the other end of which communicates with a second surface of the first valve; and a second valve provided at a point where the third flow path, the fourth flow path and the fifth flow path meet, and moved between a first position and a second position by power, such that the third flow path is communicated with the fifth flow path at the first position to supply refrigerant of a first pressure toward a second surface of the first valve, and the fourth flow path is communicated with the fifth flow path at the second position to supply refrigerant of a second pressure toward a second surface of the first valve.

Here, the third flow path may communicate with the back pressure chamber.

Furthermore, the third flow path may communicate with an intermediate pressure chamber having a pressure higher than or equal to a pressure of the intermediate pressure chamber through which the first flow path communicates.

Furthermore, the fourth flow path may communicate with an inner space of the casing.

Furthermore, the fourth flow path may communicate with an intermediate pressure chamber having a pressure lower than a pressure of the intermediate pressure chamber through which the first flow path communicates.

Furthermore, a plurality of first flow paths may be provided at predetermined intervals in a circumferential direction, and a plurality of the first valves may be provided to independently correspond to the plurality of first flow paths, respectively.

Furthermore, the back pressure chamber assembly may be provided with a plurality of valve spaces for allowing the plurality of first valves to respectively move in an axial direction, and a differential pressure space may be respectively provided at one side of the valve space to face a second surface of the first valve, and the fifth flow path may be branched to both sides at the middle portion to communicate with the plurality of differential pressure spaces.

Furthermore, the back pressure chamber assembly may be provided with a valve groove in which the third flow path and the fourth flow path, and the fifth flow path communicate with each other to insert the second valve.

Furthermore, the second valve may include a power supply unit; a valve portion configured to move to the first position or the second position by power supplied to the power source unit; and a passage guide portion configured to accommodate the valve portion to be inserted into the valve groove, and formed with a plurality of connection holes communicating with the third flow path and the fourth flow path, and the fifth flow path to guide the fifth flow path to communicate with the third flow path or the fourth flow path according to a first position or second position of the valve portion.

Furthermore, the passage guide portion may be fixed by a fixing pin coupled to the back pressure chamber assembly or the non-orbiting scroll.

Furthermore, a fixing groove having an annular shape may be formed on an outer circumferential surface of the passage guide portion, and the fixing pin may be engaged with the fixing groove to fix the second valve to the back pressure chamber assembly or the non-orbiting scroll.

In order to accomplish the objectives of the present disclosure, there is provided a scroll compressor, including a casing; an orbiting scroll provided with an orbiting wrap provided in an inner space of the casing to perform an orbiting motion; a non-orbiting scroll provided with a non-orbiting wrap at a first side thereof to form a compression chamber composed of a suction chamber, an intermediate pressure chamber, and a discharge chamber in engagement with the orbiting wrap, and provided with at least one bypass passage communicating from the intermediate pressure chamber to an outside of the intermediate pressure chamber; a first valve provided with a first surface to open and close the bypass passage; a back pressure chamber assembly provided at a second side of the non-orbiting scroll to form a back pressure chamber for pressurizing the non-orbiting scroll toward the orbiting scroll direction, and provided with an intermediate pressure passage communicating with the back pressure chamber, and provided with a suction pressure passage communicating with an inner space of the casing, and one end of which communicates with the intermediate pressure passage and the suction pressure passage, and the other end of which communicates with a second surface of the first valve; and a second valve provided at a point where the intermediate pressure passage and the suction pressure passage, and the back pressure passage meet, and moved between a first position and a second position by power, such that the intermediate pressure chamber is communicated with the back pressure passage at the first position to supply refrigerant of an intermediate pressure toward a second surface of the first valve, and the suction pressure passage is communicated with the back pressure passage at the second position to supply refrigerant of a suction pressure toward a second surface of the first valve.

Here, the bypass passage may include a first flow path formed axially through the non-orbiting scroll, one end of which communicates with the intermediate pressure chamber and the other end of which faces a first surface of the first valve; and a second flow path formed at a predetermined depth on either one of surfaces where the non-orbiting scroll and the back pressure chamber assembly are in contact with each other.

Furthermore, a plurality of bypass passages may be provided at predetermined intervals in a circumferential direction, and a plurality of the first valves may be provided to independently correspond to the plurality of bypass passages, respectively.

Furthermore, the back pressure chamber assembly may be provided with a plurality of valve spaces for allowing the plurality of first valves to respectively move in an axial direction, and a differential pressure space may be respectively provided at one side of the valve space to face a second surface of the first valve, and the back pressure passage may be branched to both sides at the middle portion to communicate with the plurality of differential pressure spaces.

In a scroll compressor according to the present disclosure, a valve for operating the first valve assembly may be configured with the second valve assembly that is electronically formed to reduce a number of components as well as a flow path for bypassing refrigerant may also be simple to facilitate manufacture. Furthermore, the reliability of the switching operation of the first valve assembly may be enhanced.

In addition, a valve for opening and closing the bypass passage of the refrigerant may be configured with a piston valve operated by a small pressure change, thereby enhancing the responsiveness of the valve to quickly switch the operation mode of the compressor.

Moreover, a check valve for bypassing refrigerant in the compression chamber may be provided, and also the check valve may be provided between the non-orbiting scroll and the back pressure chamber assembly, thereby reducing a number of components and a number of assembly processes as well as reducing manufacturing cost.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 7B is a schematic view illustrating the operation of a check valve and a valve assembly according to the operation mode of the compressor in FIG. 3 when in a saving mode.

DETAILED DESCRIPTION OF THE INVENTION

Hereinafter, a scroll compressor according to the present disclosure will be described in detail with reference to an embodiment illustrated in the accompanying drawings.

Figure 1:
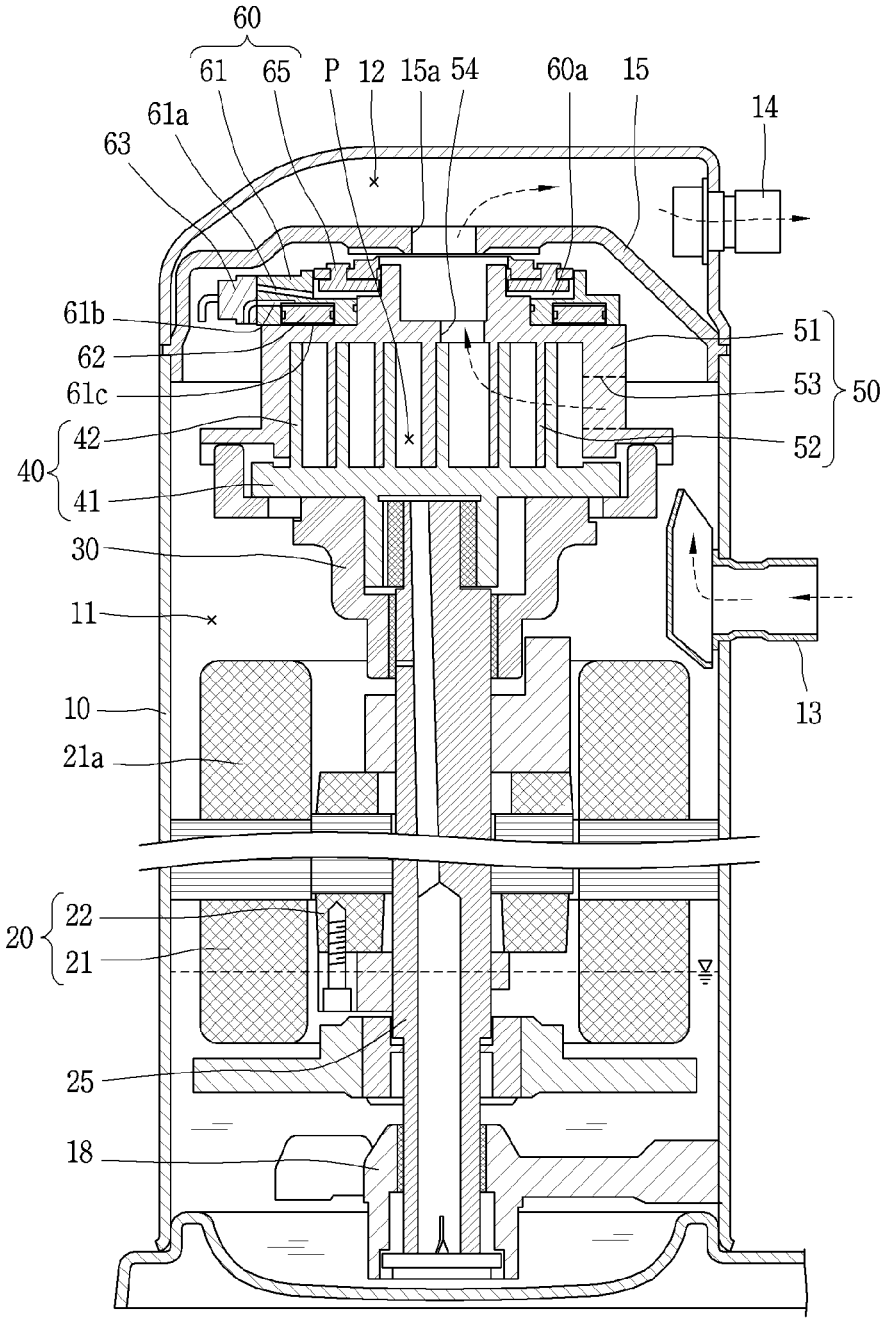
FIG. 1 RELATED ART
FIG. 1 is a longitudinal cross-sectional view illustrating a scroll compressor having a capacity variable device in the related art.
Figure 2A:
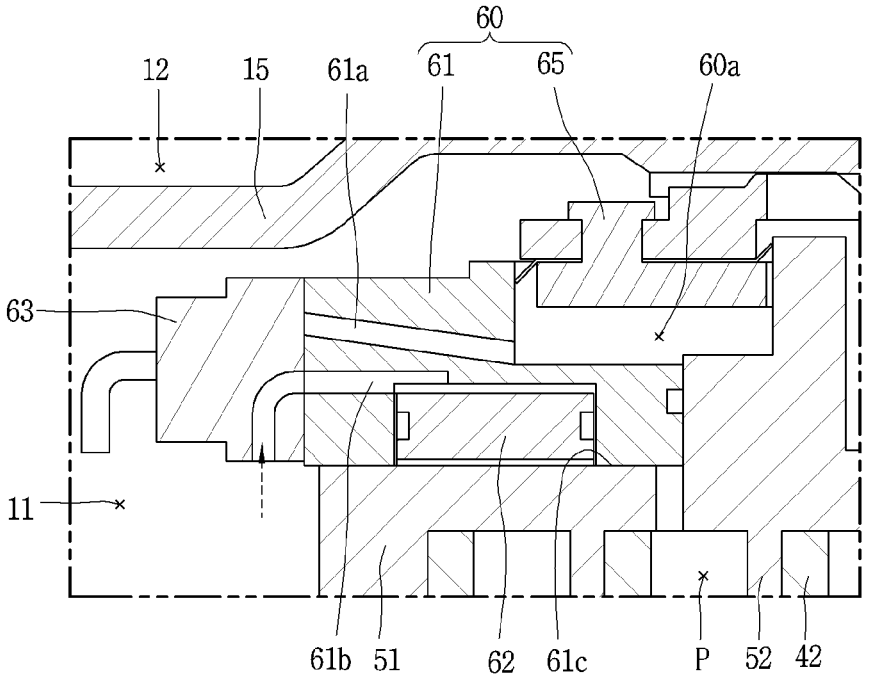
FIG. 2A RELATED ART
FIG. 2A is a longitudinal cross-sectional view illustrating a power operation and a saving operation state using a capacity variable device in the scroll compressor according to FIG. 1.
Figure 2B:
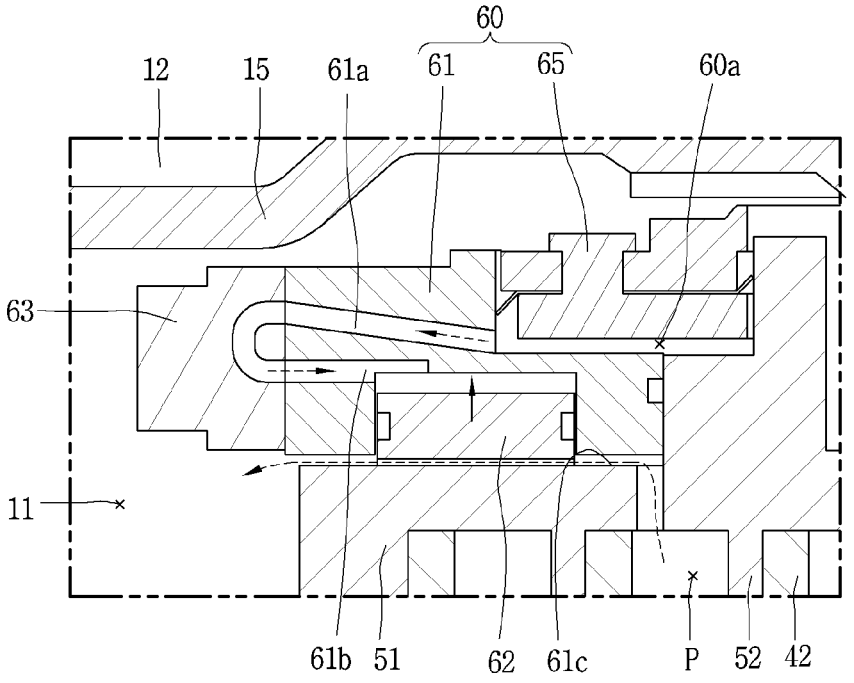
FIG. 2B RELATED ART
FIG. 2B is a longitudinal cross-sectional view illustrating a power operation and a saving operation state using a capacity variable device in the scroll compressor according to FIG. 1.
Figure 3:
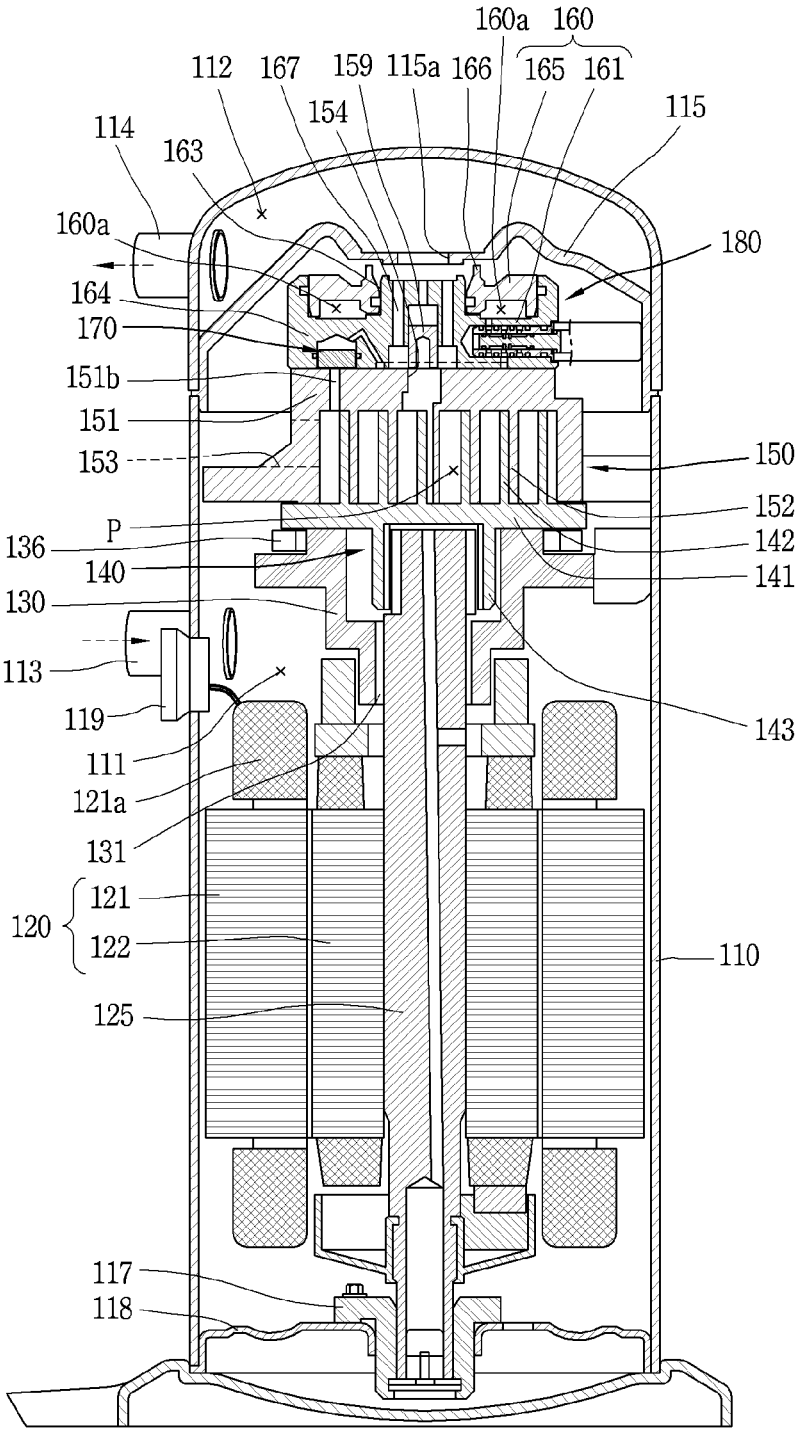
FIG. 3 is a longitudinal cross-sectional view illustrating a scroll compressor having a capacity variable device according to the present disclosure.
Figure 4:
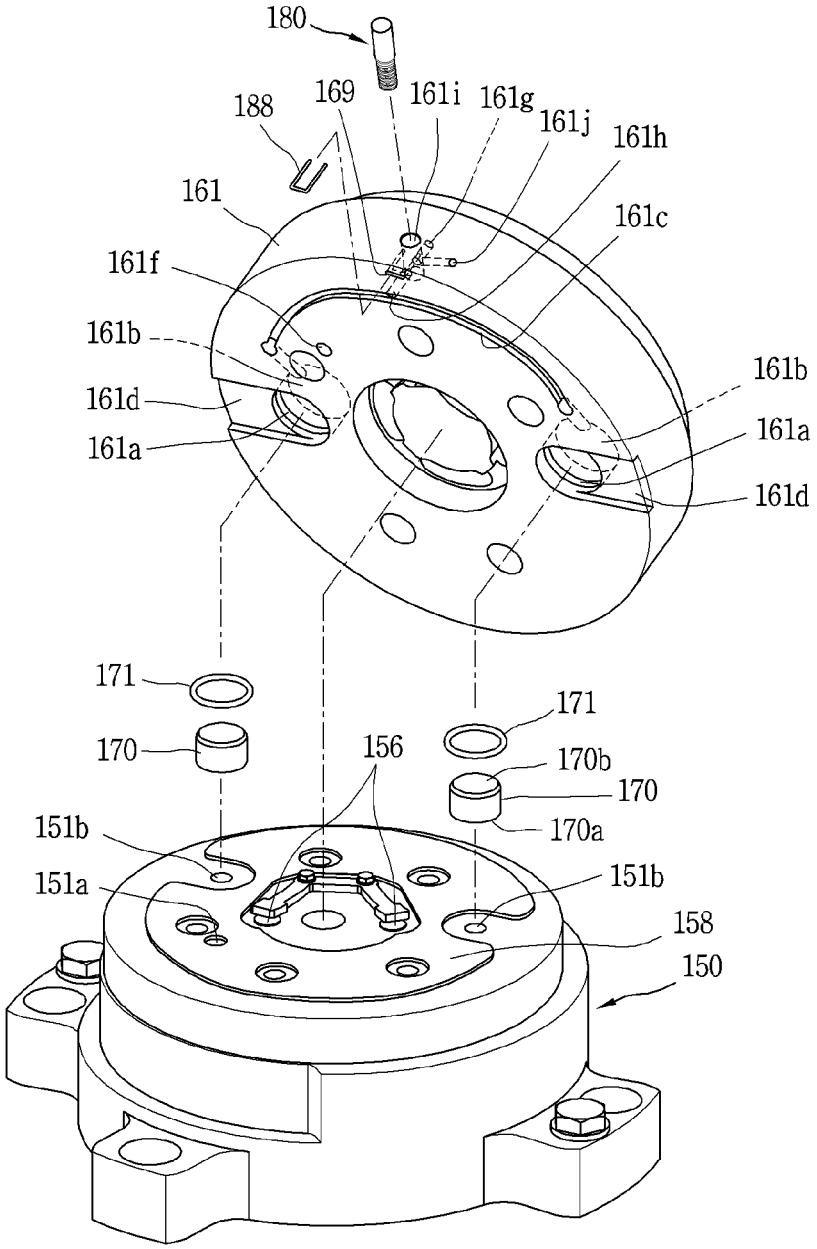
FIG. 4 is an exploded perspective view illustrating the capacity variable device according to FIG. 3.
Figure 5:
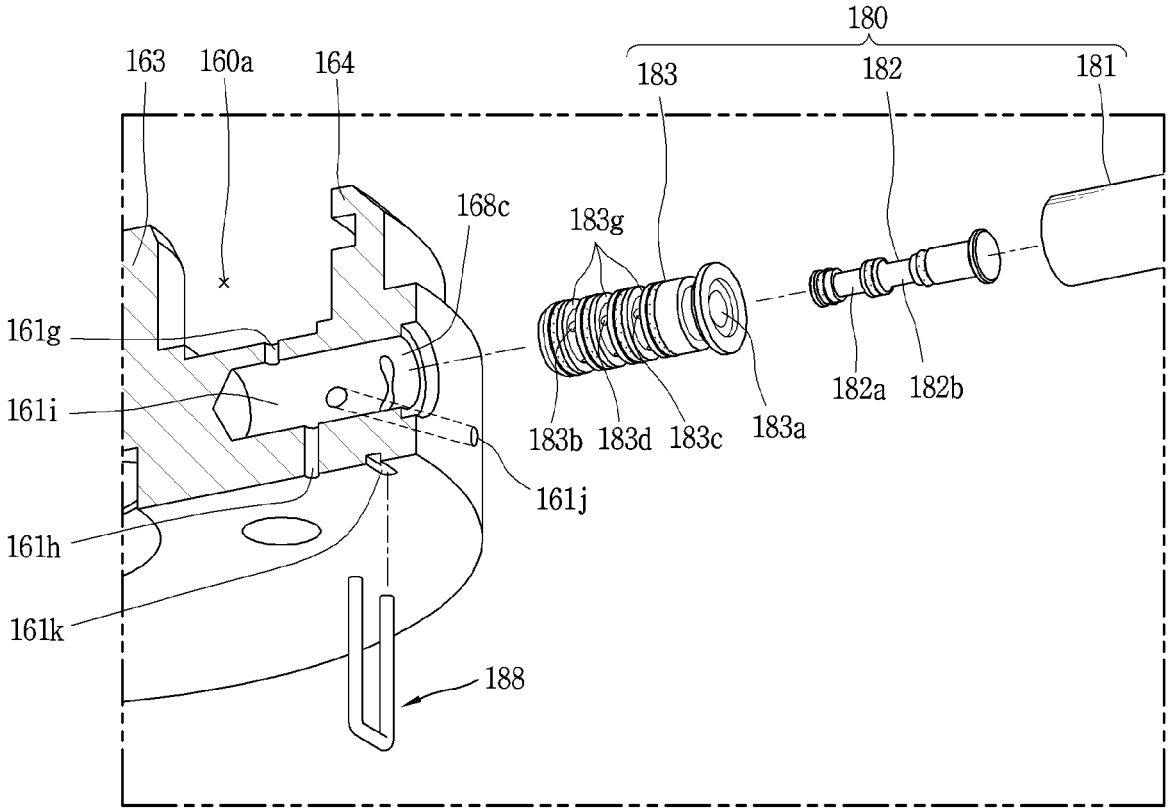
FIG. 5 is an exploded perspective view illustrating a second valve assembly in the capacity varying device according to FIG. 4.
Figure 6:
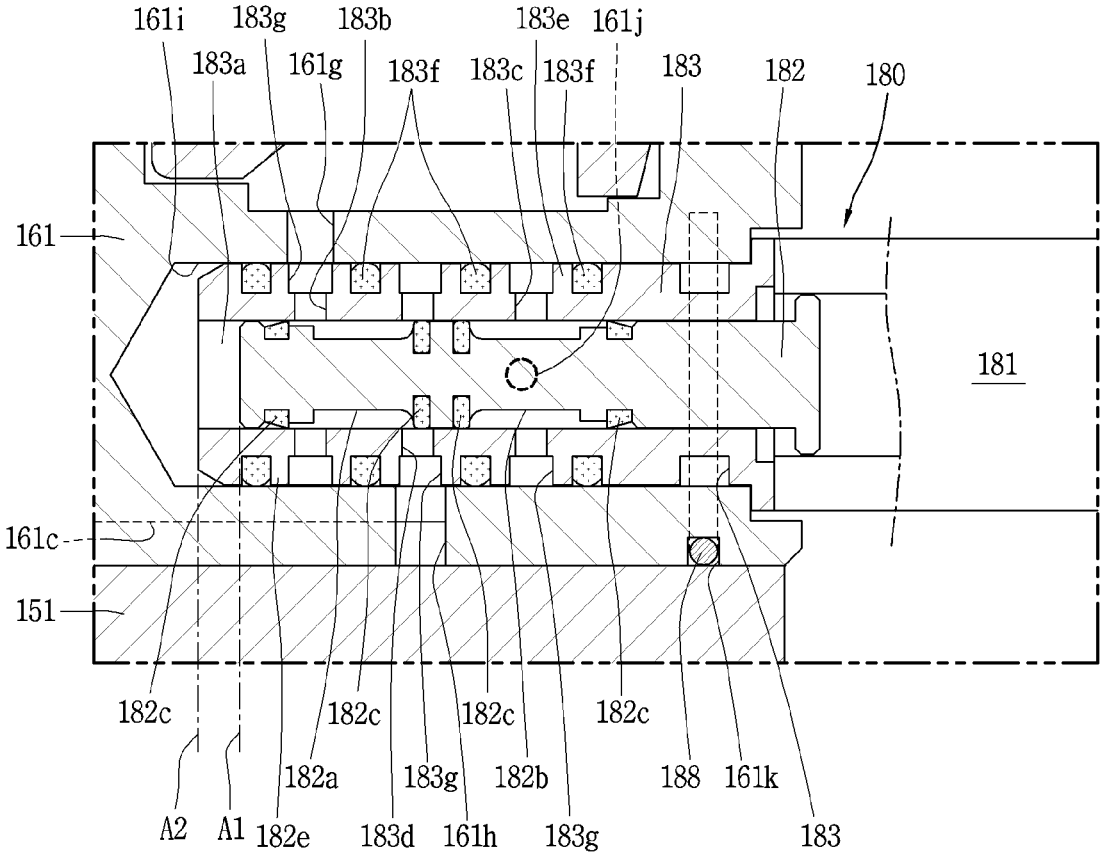
FIG. 6 is an assembled cross-sectional view illustrating the capacity variable device according to FIG. 5.

FIG. 3 is a longitudinal cross-sectional view illustrating a scroll compressor having a capacity variable device according to the present disclosure, and FIG. 4 is an exploded perspective view illustrating the capacity variable device according to FIG. 3, and FIG. 5 is an exploded perspective view illustrating a second valve assembly in the capacity varying device according to FIG. 4, and FIG. 6 is an assembled cross-sectional view illustrating the capacity variable device according to FIG. 5.

As illustrated in FIG. 3, in a scroll compressor according to the present embodiment, a closed inner space of the casing 110 is divided into a suction space 111, which is a low pressure portion, and a discharge space 112, which is a high pressure portion, by a high-low pressure separation plate 115 installed at an upper side of a non-orbiting scroll (hereinafter, used interchangeably with a second scroll) which will be described later. Here, the suction space 111 corresponds to a lower space of the high-low pressure separation plate 115, and the discharge space 112 corresponds to an upper space of the high-low pressure separation plate.

Furthermore, a suction pipe 113 communicating with the suction space 111 and a discharge pipe 114 communicating with the discharge space 112 are respectively fixed to the casing 110 to suck refrigerant into the inner space of the casing 110 or discharge refrigerant out of the casing 110.

A drive motor 120 having a stator 121 and a rotor 122 is provided in the suction space 111 of the casing 110. The stator 121 is fixed to an inner wall surface of the casing 110 in a heat shrinking manner, and a rotation shaft 125 is inserted and coupled to a central portion of the rotor 122. A coil 121*a* is wound around the stator 121, and the coil 121*a* is electrically connected to an external power source through a terminal 119 which is penetrated and coupled to the casing 110 as illustrated in FIGS. 3 and 4.

A lower side of the rotation shaft 125 is rotatably supported by an auxiliary bearing 117 provided below the casing 110. The auxiliary bearing 117 is supported by a lower frame 118 fixed to an inner surface of the casing 110 to stably support the rotation shaft 125. The lower frame 118 may be welded and fixed to an inner wall surface of the casing 110, and a bottom surface of the casing 110 is used as an oil storage space. Oil stored in the oil storage space is transferred to the upper side by the rotation shaft 125 or the like, and the oil enters the drive unit and the compression chamber to facilitate lubrication.

An upper end portion of the rotation shaft 125 is rotatably supported by the main frame 130. The main frame 130 is fixed and installed on an inner wall surface of the casing 110 like the lower frame 118, and a downwardly protruding main bearing portion 131 is formed on a lower surface thereof, and the rotation shaft 125 is inserted into the main bearing portion 131. An inner wall surface of the main bearing portion 131 functions as a bearing surface, and supports the rotation shaft 125 together with the above-described oil so as to be smoothly rotated.

An orbiting scroll (hereinafter, used interchangeably with a first scroll) 140 is disposed on an upper surface of the main frame 130. The first scroll 140 includes a first end plate portion 141 having a substantially disk shape and an orbiting wrap (hereinafter, referred to as a first wrap) 142 spirally formed on one side surface of the first end plate portion 141. The first wrap 142 forms a compression chamber (P) together with a second wrap 152 of a second scroll 150 which will be described later.

The first end plate portion 141 of the first scroll 140 is orbitably driven while being supported by an upper surface of the main frame 130, and an Oldham ring 136 is provided between the first end plate portion 141 and the main frame 130 to prevent the rotation of the first scroll 140.

Furthermore, a boss portion 143 into which the rotation shaft 125 is inserted is formed on a bottom surface of the first end plate scroll 141 of the first scroll 140, and as a result, the first scroll 140 is orbitably driven by a rotational force of the rotation shaft 125.

The non-orbiting scroll 150 (hereinafter, used interchangeably with the second scroll) engaging with the first scroll 140 is disposed at an upper portion of the first scroll 140. Here, the second scroll 150 is provided to be movable up and down with respect to the first scroll 140, and more specifically, a plurality of guide pins (not shown) inserted into the main frame 130 are placed and supported on an upper surface of the main frame 130 in a state of being inserted into a plurality of guide holes (not shown) formed on an outer circumferential portion of the second scroll 150.

On the other hand, an upper surface of a body portion of the second scroll 150 is formed in a circular plate shape to form a second end plate portion 151, and the second wrap 152 engaging with the first wrap 142 of the foregoing first scroll 140 is formed in a spiral shape at a lower portion of the second end plate portion 151.

A suction port 153 for sucking refrigerant existing within the suction space 111 is formed in a side surface of the second scroll 150, and a discharge port 154 for discharging the compressed refrigerant is formed in a substantially central portion of the second end plate portion 151.

As described above, the first wrap 142 and the second wrap 152 form a plurality of compression chambers (P), and the compression chambers are orbitably moved to a side of the discharge port 154 while reducing the volume to compress refrigerant. Therefore, a pressure of the compression chamber adjacent to the suction port 153 is minimized, a pressure of the compression chamber communicating with the discharge port 154 is maximized, and a pressure of the compression chamber existing therebetween forms an intermediate pressure having a value between a suction pressure of the suction port 153 and a discharge pressure of the discharge port 154. The intermediate pressure is applied to the back pressure chamber 160*a* which will be described later to perform the role of pressing the second scroll 150 toward the first scroll 140, and thus a scroll side back pressure hole 151*a* communicating with one of regions having the intermediate pressure, from which refrigerant is discharged, is formed on the second end plate portion 151.

A back pressure plate 161 constituting part of the back pressure chamber assembly 160 is fixed to an upper portion of the second end plate portion 151 of the second scroll 150. The back pressure plate 161 is formed in a substantially annular shape, and has a support plate portion 162 in contact with the second end plate portion 151 of the second scroll 150. The support plate portion 162 has an annular plate shape with a hollow center, and a plate side back pressure hole 161*d* communicating with the foregoing scroll side back pressure hole 151*a* is formed to penetrate the support plate portion 162.

Furthermore, first and second annular walls 163, 164 are formed on an upper surface of the support plate portion 162 to surround the inner and outer circumferential surfaces of the support plate portion 162. An outer circumferential surface of the first annular wall 163, an inner circumferential surface of the second annular wall 164, and an upper surface of the support plate portion 162 form an annular back pressure chamber 160*a*.

A floating plate 165 constituting an upper surface of the back pressure chamber 160*a* is provided at an upper side of the back pressure chamber 160*a*. A sealing end portion 166 is provided at an upper end portion of an inner space portion of the floating plate 165. The sealing end portion 166 is formed to protrude upward from a surface of the floating plate 165, and its inner diameter is formed to such an extent that it does not cover the intermediate discharge port 167. The sealing end portion 166 is in contact with a lower surface of the high-low pressure separation plate 115 to perform the role of sealing the discharged refrigerant to be discharged into the discharge space 112 without leaking into the suction space 111.

In the drawing, reference numeral 156 denotes a bypass valve (first bypass valve) for opening and closing a discharge bypass hole (first bypass hole) for bypassing part of refrigerant compressed in the intermediate pressure chamber to prevent over-compression, and reference numeral 159 denotes a check valve for blocking refrigerant discharged to the discharge space from flowing back to the compression chamber.

The foregoing scroll compressor according to this embodiment operates as follows.

In other words, when electric power is applied to a side of the stator 121, the rotation shaft 125 rotates. Then, the first scroll 140 coupled to an upper end portion of the rotation shaft 125 performs an orbiting motion with respect to the second scroll 150 as the rotation shaft 125 rotates, and due to this, refrigerant is compressed while a plurality of compression chambers (P) formed between the second wrap 152 and the first wrap 142 move to a side of the discharge port 154.

When the compression chamber (P) is communicated with the scroll side back pressure hole (not shown) before reaching the discharge port 154, part of refrigerant flows into the plate side back pressure hole (not shown) formed on the support plate portion 162, and accordingly, an intermediate pressure is applied to the back pressure chamber 160*a* formed by the back pressure plate 161 and the floating plate 165. As a result, the back pressure plate 161 is pressurized downward, and the floating plate 165 is pressurized upward.

Here, since the back pressure plate 161 is coupled to the second scroll 150 by bolts, an intermediate pressure of the back pressure chamber 160*a* also affects the second scroll 150. However, since the second scroll 150 is already in contact with the first end plate portion 141 of the first scroll 140 not to move downward, the floating plate 165 moves upward. The floating plate 165 blocks refrigerant from leaking into the suction space 111, which is a low pressure portion, from the discharge space 112, which is a high pressure portion, while the sealing end portion 166 is brought into contact with a lower end portion of the high-low pressure separation plate 115. Moreover, a pressure of the back pressure chamber 160*a* pushes the second scroll 150 toward the first scroll 140 to block leakage between the first scroll 140 and the second scroll 150.

When the capacity variable device is applied to the scroll compressor according to the present embodiment, a capacity variable bypass hole (hereinafter, abbreviated as a second bypass hole) 151*b* communicating with the intermediate pressure chamber while forming a first flow path is formed through the intermediate pressure chamber to the back surface on the second end plate portion 151 of the second scroll 150. The second bypass holes 151*b* are formed on both sides at 180-degrees intervals to bypass the intermediate pressure refrigerant at the same pressure in an inner pocket and an outer pocket. However, when it is asymmetric in which a wrap length of the first wrap 142 is larger than that of the second lap 152 by 180 degrees, the same pressure is formed at the same crank angle in the inner pocket and the outer pocket, and thus two second bypass holes 151*b* may be formed at the same crank angle or only one second bypass hole 151*b* may be formed.

Furthermore, a capacity variable bypass valve (hereinafter, referred to as a second bypass valve) 170 is provided at an end portion of the second bypass hole 151*b* to selectively open and close the second bypass hole 151*b*. The second bypass valve 170 constitutes a first valve assembly, and may be formed as a piston valve that is opened or closed according to a pressure of the intermediate pressure chamber.

As illustrated in FIGS. 4 and 5, an intermediate pressure hole 161*g* is formed on the back pressure plate 161 according to the present embodiment from an upper surface forming the back pressure chamber 160*a* toward a lower surface of the back pressure plate 161. The intermediate pressure hole 161*g* allows part of refrigerant in the back pressure chamber 160*a* to be guided to a differential pressure space 161*b* through the back pressure passage 161*c* constituting a fifth flow path to be described later.

Furthermore, a plurality of valve spaces 161*a* are formed to be recessed by a predetermined depth in an axial direction on a lower surface of the back pressure plate 161 to allow the second bypass valves 170 for selectively opening and closing the second bypass holes 151*b* to be respectively slid in the axial direction.

In addition, a differential pressure space 161*b* having a predetermined volume at a rear side of the second bypass valve 170 by interposing the second bypass valve 170 constituting the first valve assembly is formed at one side of the valve space 161*a* in an axial direction.

Here, the differential pressure spaces 161*b* are formed on both sides with a phase difference of 180 degrees together with the valve space 161*a*, and both the differential pressure spaces 161*b* are communicated with each other by the back pressure passage 161*c* formed on a lower surface of the back pressure plate 161. In this case, as illustrated in FIG. 5, both ends of the back pressure passage 161*c* are formed to be inclined toward the respective differential pressure spaces 161*b*, and a transverse cross-sectional area of the differential pressure space 161*b* is formed to be larger than that of the second bypass hole 151*b*.

Furthermore, the back pressure passage 161*c* is formed on a lower surface of the back pressure plate 161 and sealed by an upper surface of the non-orbiting scroll 150. At this time, the back pressure passage 161*c* is preferably overlapped with a gasket 158 provided on an upper surface of the non-orbiting scroll 150 to seal the back pressure passage 161*c*. On the other hand, though not shown in the drawing, the back pressure passage may be formed on an upper surface of the non-orbiting scroll, and may be formed half and half on both sides of the non-orbiting scroll and the back pressure plate.

In addition, an exhaust groove 161*d* constituting a second flow path that allows refrigerant discharged from the intermediate pressure chamber through each of the second bypass holes 151*b* to be exhausted into the suction space 1111 of the casing 110 when each of the second bypass valves is open when the second bypass valve 170 is open is formed on a lower surface of the back pressure plate 161 to communicate independently with a side surface of each back pressure space 161*a*.

The exhaust groove 161*d* is formed in a radial direction from an inner circumferential surface of the valve space 161*a* to an outer circumferential surface of the back pressure plate 161 to allow the other end thereof to communicate with an inner space 111 of the casing 110. As a result, as both the second bypass holes 151*b* communicate independently with the suction space 111 of the casing 110 through the respective exhaust grooves 161*d*, refrigerant bypassed from the compression chamber through both the second bypass holes 151*b* is directly discharged into the suction space 111 of the casing 110 without being merged into one place. Accordingly, refrigerant bypassed from the compression chamber may be prevented from being heated by the refrigerant of the back pressure chamber 160*a*. In addition, when the refrigerant bypassed from the compression chamber to the suction space 111 of the casing 110 is heated, a volume ratio thereof may increase to suppress a suction volume from being reduced.

Besides, one end of a connection passage 161*h* constituting part of the back pressure passage 161*c* is connected to an intermediate portion of the back pressure passage 161*c*, and the other end of the connection passage 161*h* is connected to a valve groove 161*i* into which a passage guide portion 183 of a second valve assembly (hereinafter, used interchangeably with a control valve) 180 which will be described later is inserted. The valve groove 161*i* allows the intermediate pressure hole 161*g* as a third flow path and the suction pressure hole 161*j* as a fourth flow path to communicate with a connection passage 161*h* as a fifth flow path through the connection holes 183*b*, 183*c*, 183*d* of the passage guide portion 183 which will be described. The other end of the suction pressure hole 161*j* as a fourth flow path may be passed through an outer circumferential surface of the back pressure plate 161 to communicate with an inner space 111 of the casing 110.

Here, the control valve 180 constituting the second valve assembly may be configured with a solenoid valve and inserted and fixed to the valve groove 161*i* provided to be recessed by a predetermined length in a radial direction on the back pressure plate 161.

The control valve 180 may be pressed and fixed to the valve groove 161*i*, but according to circumstances, the control valve 180 may be fixed to the valve groove 161*i* in a length direction of the valve groove 161*i* using a fixing pin 188 coupled to the back pressure plate 161. For this purpose, a fixing pin insertion groove 161*k* may be formed on the back pressure plate 161, and a fixing groove 183*h* having an annular shape into which the fixing pin 188 is inserted and caught may be formed on the passage guide portion 183 of the control valve 180 which will be described later. The fixing pin 188 is formed in a U-shape and both ends of the fixing pin 188 are caught into the fixing groove 183*h* of the passage guide portion 183 to fix the control valve 180.

On the other hand, the control valve 180 is composed of a solenoid valve having a power supply unit 181 connected to external power to move a mover 181*b* between a first position and a second position depending on whether or not the external power is applied thereto. Therefore, hereinafter, the control valve is used interchangeably with a solenoid valve.

A power supply unit 181 is provided with a mover (not shown) inside a coil (not shown) to which power is supplied, and a return spring (not shown) is provided at one end of the mover. The other end of the mover is coupled to a valve portion 182 for allowing a first connection hole 183*b* to communicate with a third connection hole 183*d* or allowing a second connection hole 183*c* to communicate with the third connection hole 183*d* in the passage guide portion 183 which will be described later.

Furthermore, the valve portion 182 may be formed in a circular rod shape and first and second connection grooves 182*a*, 182*b* may be formed on an outer circumferential surface of the valve portion 182, and O-rings 182*c* for sealing the first connection groove 182*a* and the second connection groove 182*b* may be inserted on both sides of the first connection groove 182*a*, on both sides of the second connection groove 182*b*, and between the first connection groove 182*a* and the second connection groove 182*b*. As a result, the first connection hole 183*b* and the third connection hole 183*d*, which will be described later, may be connected when the valve portion 182 is moved to the first position (A1), and the second connection hole 183*c* and the third connection hole 183*d*, which will be described later, can be connected when the valve portion 182 is moved to the second position (A2)

In addition, the passage guide portion 183 may be formed in a cylindrical shape, and a valve space 183*a* into which the valve portion 182 is slidably inserted may be formed therein. A first connection hole 183*b* for communicating between the valve space 183*a* and the intermediate pressure hole 161*g* is formed at one end portion of the passage guide portion 183, and a second connection hole 183*c* for communicating between the first connection hole 183*a* and the suction pressure hole 161*j* is formed at the other end portion of the passage guide portion 183, and a third connection hole 183*d* communicating with the connection passage 161*h* of the back pressure passage 161*c* may be formed between the first connection hole 183*a* and the second connection hole 183*c*. As a result, the first connection hole 183*b*, the second connection hole 183*c* and the third connection hole 183*d* may be formed to communicate with each other in the valve space 183*a*, and thus the connection hole 183*d* may be selectively communicated with the first connection hole 183*b* or the second connection hole 183*c* by the valve portion 182.

Here, sealing protrusion portions 183*e* are formed at a predetermined height at an outside of the first connection hole 183*b* and an outside of the second connection hole 183*c*, between the first connection hole 183*b* and the third connection hole 183*d*, and between the second connection hole 183*c* and the third connection hole 183*d*, respectively, and O-rings 183*f* are respectively provided at each of the sealing protrusions 183*e*. As a result, a space 183*g* is formed between an inner circumferential surface of the valve groove 161*i* and a periphery of the inlets of the first connection hole 183*b*, the second connection hole 183*c*, and the third connection hole 183*d*, respectively. Accordingly, only one of the first connection hole 183*b*, the second connection hole 183*c*, and the third connection hole 183*d* may be formed, but a plurality of connection holes may also be formed using the space 183*g* formed around the inlet of each of the foregoing connection holes.

In the drawing, reference numerals 119, 170*a*, 170*b*, 161*f*, 165 and 171 denote a terminal, an opening and closing surface, a back pressure surface, a plate side back pressure hole, a floating plate, and an O-ring, respectively.

Figure 7A:
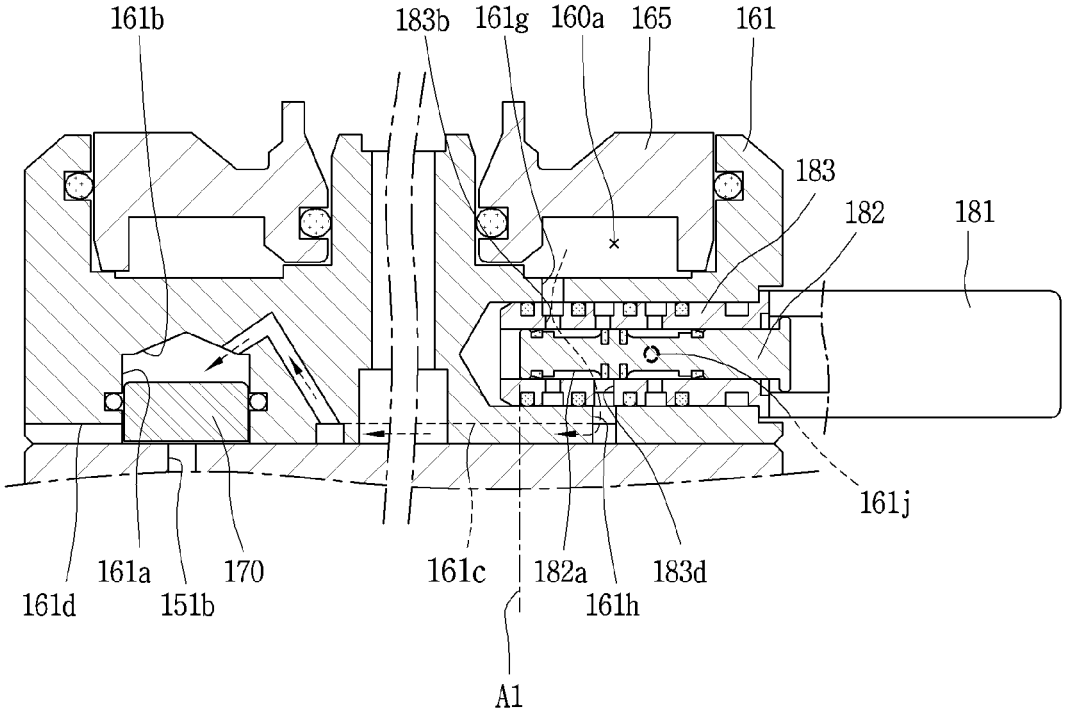
FIGS. 7A and 7B are schematic views illustrating the operation of a check valve and a valve assembly according to the operation mode of the compressor in FIG. 3 when in a power mode.
Figure 7B:
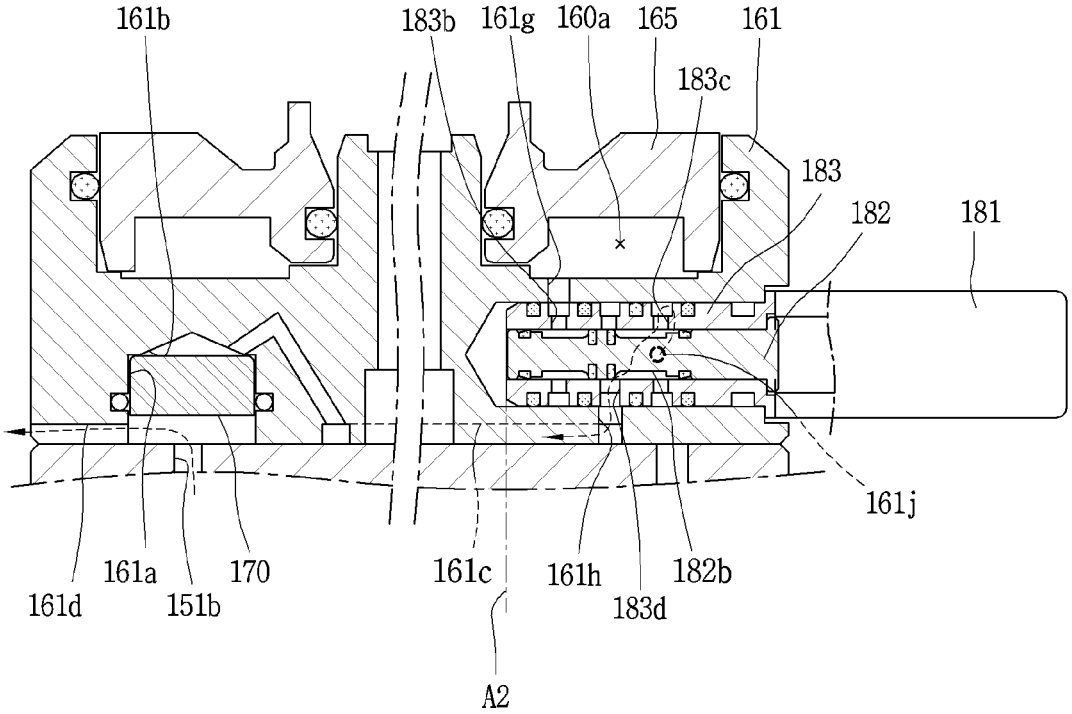

The process of varying the capacity of the compressor in the scroll compressor according to the present disclosure will be operated as follows. FIGS. 7A and 7B are schematic views illustrating the operation of a check valve and a valve assembly according to the operation mode of the compressor in FIG. 3, wherein FIG. 7A is a power mode and FIG. 7B is a saving mode.

First, when the compressor is operated in a power mode as illustrated in FIGS. 6 and 7A, power is applied to the control valve 180, which is the second valve assembly, and the valve 182 is then moved to the first position (A1). Then, the first connection hole 183*b* and the third connection hole 183*d* of the passage guide portion 183 are connected by the first connection groove 182*a* of the valve portion 182, and thus the intermediate pressure hole 161*g* and the connection passage 161*h* are connected to each other. Then, the intermediate pressure refrigerant flows into the both differential pressure spaces 161*b* through the back pressure passage 161*c*.

Then, a pressure of the differential pressure space 161*b* pressurizes the back pressure surface 170*b* of the second bypass valve 170 while forming an intermediate pressure higher than a pressure of the intermediate pressure chamber communicated with the bypass hole. At this time, since a transverse cross-sectional area of the differential pressure space 161*b* is larger than that of the second bypass hole 151*b*, both the second bypass valves 170 are pressed against the pressure of the differential pressure space 161*b* to block the respective second bypass holes 151*b*. As a result, refrigerant in the compression chamber is not leaked to both the second bypass holes 151*b*, and thus the compressor may continue a power operation.

On the other hand, when the compressor is operated in a saving mode as shown in FIGS. 6 and 7B, power is turned off at the control valve 180, which is a second valve assembly, and then the valve portion 182 is returned to the second position (A2) by the return spring (not shown). Then, the second connection hole 183*c* and the third connection hole 183*d* of the passage guide portion 183 are connected by the second connection groove 182*b* of the valve portion 182, and thus the suction pressure hole 161*j* and the connection passage 161*h* are connected to each other. Then, the intermediate pressure refrigerant flows into the both differential pressure spaces 161*b* through the back pressure passage 161*c*.

Then, a pressure of the differential pressure space 161*b* pressurizes the back pressure surface 170*b* of the second bypass valve 170 while forming a suction pressure. At this time, since a pressure of the intermediate pressure chamber is formed to be higher than that of the differential pressure space 161*b*, both the second bypass valves 170 are respectively pressed and raised by the pressure of the intermediate pressure chamber.

Then, as refrigerant flows into the suction space 111 of the casing 110 through the respective exhaust grooves 161*d* in the respective intermediate pressure chambers while opening both the second bypass holes 151*b*, the compressor performs a saving operation.

In this manner, part of refrigerant compressed in the intermediate pressure chamber may be bypassed at the time of over-compression, thereby increasing the efficiency of the compressor.

In addition, a valve for opening and closing the bypass passage of the refrigerant may be configured with a piston valve operated by a small pressure change, thereby quickly switching the operation mode of the compressor.

Besides, a valve for operating the first valve assembly may be configured with the second valve assembly that is electronically formed to reduce a number of components as well as a flow path for bypassing refrigerant may also be simple to facilitate manufacture. Furthermore, the reliability of the switching operation of the first valve assembly may be enhanced.

Meanwhile, another embodiment of the scroll compressor according to the present disclosure will be described as follows.

In other words, in the above-described embodiment, both the first valve assembly, which is a check valve, and the second valve assembly, which is a solenoid valve, are provided on the back pressure plate, but according to circumstances, the first valve assembly and the second valve assembly may also be provided on different members. For example, the first valve assembly may be installed on the back pressure plate while the second valve assembly is installed on the non-orbiting scroll, or vice versa. According to another embodiment, both the first valve assembly and the second valve assembly may be installed on the non-orbiting scroll. These embodiments differ only in the installation position of the first valve assembly and the second valve assembly from the foregoing embodiment, but their basic configurations and operation effects are similar to each other, and thus the detailed description thereof will be omitted.

Meanwhile, still another embodiment of the scroll compressor according to the present disclosure will be described as follows.

In other words, according to the above-described embodiments, the intermediate pressure hole may be connected to the back pressure chamber to supply an intermediate pressure of the back pressure chamber to the differential pressure space. However, according to the present embodiment, it is configured in such a manner that an intermediate pressure of the intermediate pressure chamber is supplied to the differential pressure space.

Figure 8:
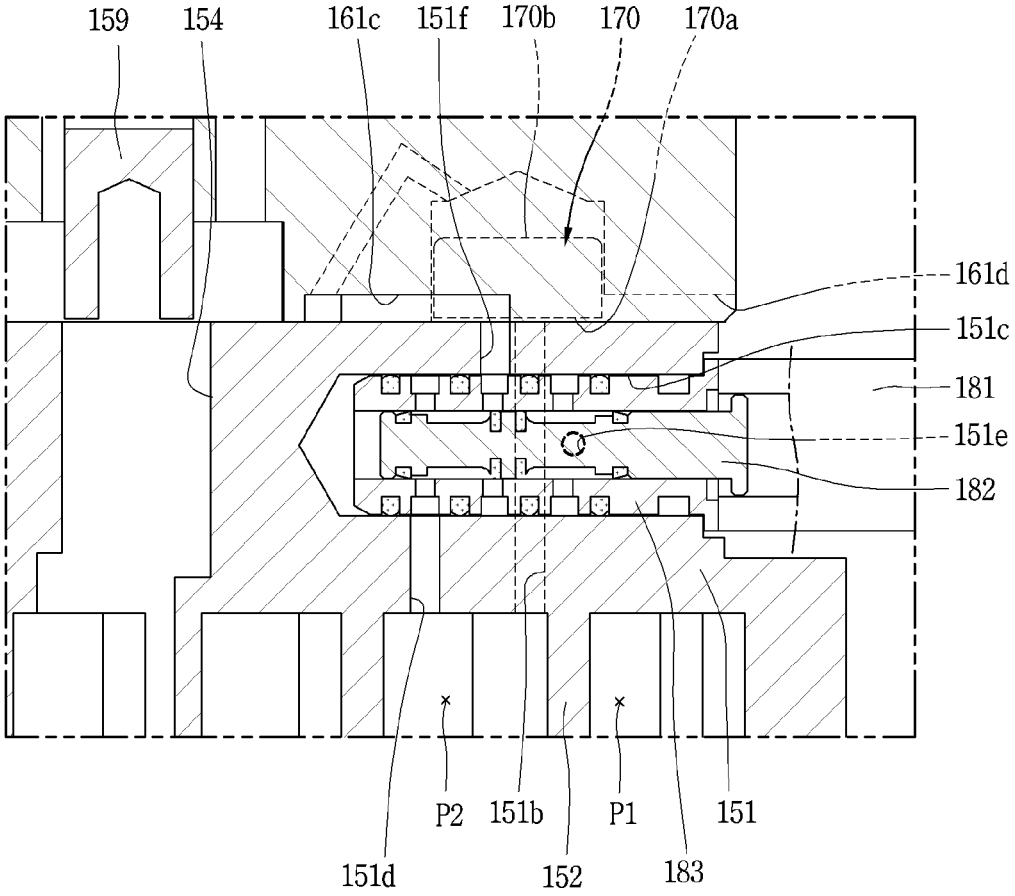
FIG. 8 is a cross-sectional view illustrating an example in which the capacity variable device according to FIG. 3 is installed in a non-orbiting scroll.

For example, as illustrated in FIG. 8, a valve groove 151*c* is formed in a central direction from an outer circumferential surface of the second end plate portion 151 of the second scroll 150, which is a non-orbiting scroll, and an intermediate pressure hole 151*d* penetrated from the middle of the valve groove 151*c* toward the second intermediate pressure chamber (P2) to form a third flow passage is formed.

Furthermore, a suction pressure hole 151*e* penetrated from the middle of the valve groove 151*c* toward an outer circumferential surface of the second end plate portion 151 to form a fourth flow passage is formed at a predetermined interval from the intermediate pressure hole 151*d* to communicate with an inner space 111 of the casing 110, and a connection passage 151*f* is formed between the intermediate pressure hole 151*d* and the suction pressure hole 151*e* to connect one end of the back pressure passage constituting the fifth passage.

Here, the configuration or operation of the first valve assembly and the valve space, the differential pressure space, and the back pressure passage into which the first valve assembly is inserted may be formed in the same or similar manner.

In addition, the second valve assembly and the valve groove into which the second valve assembly is inserted or various flow paths connected to the valve groove may also be formed in the same or similar manner as in the above embodiment.

Therefore, the capacity variable device of the scroll compressor according to the present embodiment is substantially similar to the foregoing embodiment in the basic configuration and operation effect thereof.

However, in the present embodiment, the intermediate pressure hole 151*d* is communicated with the intermediate pressure chamber unlike the foregoing embodiment, but the intermediate pressure hole 151*d* is preferably communicated with the second intermediate pressure chamber (P2) having a relatively higher pressure than the first intermediate pressure chamber (P1) communicated with the bypass hole in the foregoing embodiment to stably operate the second bypass valve 170.

In other words, during power operation, the first bypass valve 170, which is a first valve assembly, must maintain a closed state of the second bypass hole 151*b*. For this purpose, a second intermediate pressure supplied to the differential pressure space 161*b* from the second intermediate pressure chamber (P2) should have a higher pressure than a first intermediate pressure applied to a pressure surface 170*a* of the first bypass valve 170, which is a first valve assembly, through the second bypass hole 151*b* from the first intermediate pressure chamber (P1). Therefore, the second intermediate pressure is preferably communicated with the intermediate pressure chamber having a higher pressure than the first intermediate pressure.

However, according to circumstances, the second bypass valve 170 may close the second bypass hole 151*b* during power operation even when the first intermediate pressure and the second intermediate pressure have the same pressure. In other words, a cross-sectional area of the second bypass hole 151*b* may be formed to be smaller than that of the second bypass valve 170 (or a cross-sectional area of the differential pressure space), and thus a force supplied to the differential pressure space 161*b* and applied to a negative pressure surface 170*b* of the second bypass valve 170 may be greater than that applied to a positive pressure surface 170*a* of the second bypass valve 170 through the second bypass hole 151*b*. Therefore, the intermediate pressure hole 151*d* may be connected to the intermediate pressure chamber having the same pressure as the second bypass hole 151*b*.

When the intermediate pressure hole is connected to the intermediate pressure chamber as described above, the first valve assembly may be operated using the refrigerant of the intermediate compression chamber having a relatively small pressure variation compared to the back pressure chamber, thereby stabilizing the behavior of the first valve assembly.

On the other hand, according to the foregoing embodiments, a low pressure scroll compressor has been taken as an example, but the present disclosure may be similarly applied to all hermetic compressors in which an internal space of the casing is divided into a suction space which is a low pressure portion and a high pressure discharge space which is a high pressure portion.

What is claimed is:

1. A scroll compressor, comprising:

a casing;

an orbiting scroll having an orbiting wrap located in an inner space of the casing;

a non-orbiting scroll having a non-orbiting wrap located at a first side thereof to form a compression chamber comprised of a suction chamber, an intermediate pressure chamber, and a discharge chamber in engagement with the orbiting wrap;

a back pressure chamber assembly located at a second side of the non-orbiting scroll to form a back pressure chamber for pressurizing the non-orbiting scroll to move directionally toward the orbiting scroll;

a first flow path configured to provide communication from the intermediate pressure chamber to an outside surface of the intermediate pressure chamber;

a second flow path configured to provide communication between the first flow path and the inner space of the casing;

a first valve having a first surface that opens and closes between the first flow path and the second flow path;

a third flow path located in the back pressure chamber assembly to communicate a first refrigerant having a first pressure;

a fourth flow path located in the back pressure chamber assembly to communicate a second refrigerant having a second pressure that lower than the first pressure;

a fifth flow path provided in the back pressure chamber assembly, a first end of the fifth flow path is configured to provide communication with the third flow path and the fourth flow path, and a second end of the fifth flow path is configured to provide communication with a second surface of the first valve; and a second valve located where the third flow path, the fourth flow path, and the fifth flow path meet, the second valve being configured to move between a first position and a second position, wherein the third flow path is in communication with the fifth flow path when the second valve is at the first position so as to supply the first refrigerant toward the second surface of the first valve, and wherein the fourth flow path is in communication with the fifth flow path when the second valve is at the second position so as to supply the second refrigerant toward the second surface of the first valve.

2. The scroll compressor of claim 1, wherein the third flow path is in communication with the back pressure chamber.

3. The scroll compressor of claim 1, wherein the third flow path is in communication with another intermediate pressure chamber that is different than the intermediate pressure chamber through which the first flow path communicates, the another intermediate pressure chamber having a pressure that is greater than or equal to a pressure of the intermediate pressure chamber through which the first flow path communicates.

4. The scroll compressor of claim 1, wherein the fourth flow path is in communication with the inner space of the casing.

5. The scroll compressor of claim 1, wherein the fourth flow path is in communication with another intermediate pressure chamber having a pressure that is lower than a pressure of the intermediate pressure chamber through which the first flow path communicates.

6. The scroll compressor of claim 1, wherein a plurality of first flow paths are provided at predetermined intervals in a circumferential direction, and a plurality of the first valves are provided to independently correspond to the plurality of first flow paths, respectively.

7. The scroll compressor of claim 6, wherein the back pressure chamber assembly comprises a plurality of valve spaces that allow the plurality of first valves to respectively move in an axial direction, and for each of the valve spaces, a differential pressure space is respectively provided at one side thereof facing a second surface of the first valve, and the fifth flow path is branched to both sides at the middle portion thereof so as to communicate with the plurality of differential pressure spaces.

8. The scroll compressor of claim 1, wherein the back pressure chamber assembly is formed having a valve groove to receive the second valve, and wherein the valve groove is in communication with the third flow path, the fourth flow path, and the fifth flow path.

9. The scroll compressor of claim 8, wherein the second valve comprises:

a power supply unit;

a valve portion configured to move to the first position or the second position by power supplied to the power source unit; and a passage guide portion to accommodate the valve portion to be inserted into the valve groove, the passage guide portion being formed with a plurality of connection holes that are in communication with the third flow path, the fourth flow path, and the fifth flow path so as to guide the fifth flow path to be in communication with the third flow path or the fourth flow path according to whether the valve portion is located in the first position or the second position.

10. The scroll compressor of claim 9, wherein the passage guide portion is fixed by a fixing pin that is attached to the back pressure chamber assembly.

11. The scroll compressor of claim 10, wherein a fixing groove having an annular shape is formed on an outer circumferential surface of the passage guide portion, and the fixing pin is configured to be engaged with the fixing groove so as to fix the second valve to the back pressure chamber assembly.

12. A scroll compressor, comprising:

a casing;

an orbiting scroll having an orbiting wrap located in an inner space of the casing;

a non-orbiting scroll having a non-orbiting wrap located at a first side thereof to form a compression chamber comprised of a suction chamber, an intermediate pressure chamber, a discharge chamber in engagement with the orbiting wrap, and at least one bypass passage configured to provide communication from the intermediate pressure chamber to an outside surface of the intermediate pressure chamber;

a first valve having a first surface that opens and closes the bypass passage;

a back pressure chamber assembly located at a second side of the non-orbiting scroll to form a back pressure chamber for pressurizing the non-orbiting scroll to move directionally toward the orbiting scroll direction, the back pressure chamber comprising an intermediate pressure passage that is in communication with the back pressure chamber and a suction pressure passage that is in communication with the inner space of the casing, and the back pressure chamber being configured such that a first end thereof is in communication with the intermediate pressure passage and the suction pressure passage and a second end thereof is in communication with a second surface of the first valve; and a second valve located where the intermediate pressure passage, the suction pressure passage, and the back pressure passage meet, the second valve being configured to move between a first position and a second position, wherein the intermediate pressure chamber is in communication with the back pressure passage when the second valve is at the first position so as to supply refrigerant having an intermediate pressure toward a second surface of the first valve, and wherein the suction pressure passage is communicated with the back pressure passage when the second valve is at the second position so as to supply refrigerant having a suction pressure toward a second surface of the first valve.

13. The scroll compressor of claim 12, wherein the bypass passage comprises:

a first flow path formed axially through the non-orbiting scroll such that one end of the first flow path is in communication with the intermediate pressure chamber and another end of the first flow path faces a first surface of the first valve; and a second flow path formed at a predetermined depth at a surface where the non-orbiting scroll and the back pressure chamber assembly are in contact with each other.

14. The scroll compressor of claim 12, wherein a plurality of the bypass passage is provided in plurality respectively disposed at predetermined intervals in a circumferential direction, and the first valve is provided in plurality to independently correspond to the plurality of bypass passages, respectively.

15. The scroll compressor of claim 14, wherein the back pressure chamber comprises a plurality of valve spaces that allow the plurality of first valves to respectively move in an axial direction, and for each of the valve spaces, a differential pressure space is respectively provided at one side thereof facing a second surface of the first valve, and the back pressure passage is branched to both sides at the middle portion thereof so as to communicate with the plurality of differential pressure spaces.

16. A scroll compressor, comprising:

a casing;

an orbiting scroll having an orbiting wrap located in an inner space of the casing;

a non-orbiting scroll having a non-orbiting wrap located at a first side thereof to form a compression chamber comprised of a suction chamber, an intermediate pressure chamber, and a discharge chamber in engagement with the orbiting wrap;

a back pressure chamber assembly located at a second side of the non-orbiting scroll to form a back pressure chamber for pressurizing the non-orbiting scroll to move directionally toward the orbiting scroll;

a first flow path configured to provide communication from the intermediate pressure chamber to an outside surface of the intermediate pressure chamber;

a second flow path configured to provide communication between the first flow path and the inner space of the casing;

a first valve having a first surface that opens and closes between the first flow path and the second flow path;

a third flow path located in the non-orbiting scroll to communicate a first refrigerant having a first pressure;

a fourth flow path located in the non-orbiting scroll to communicate a second refrigerant having a second pressure that lower than the first pressure;

a fifth flow path provided in the non-orbiting scroll, a first end of the fifth flow path is configured to provide communication with the third flow path and the fourth flow path, and a second end of the fifth flow path is configured to provide communication with a second surface of the first valve; and a second valve located where the third flow path, the fourth flow path, and the fifth flow path meet, the second valve being configured to move between a first position and a second position, wherein the third flow path is in communication with the fifth flow path when the second valve is at the first position so as to supply the first refrigerant toward the second surface of the first valve, and wherein the fourth flow path is in communication with the fifth flow path when the second valve is at the second position so as to supply the second refrigerant toward the second surface of the first valve.

17. The scroll compressor of claim 16, wherein the third flow path is in communication with another intermediate pressure chamber that is different than the intermediate pressure chamber through which the first flow path communicates, the another intermediate pressure chamber having a pressure that is greater than or equal to a pressure of the intermediate pressure chamber through which the first flow path communicates.

18. The scroll compressor of claim 16, wherein the first flow path is provided in plurality at predetermined intervals in a circumferential direction, and the first valve is provided in plurality to independently correspond to the plurality of first flow paths, respectively.

19. The scroll compressor of claim 18, wherein the back pressure chamber assembly comprises a plurality of valve spaces that allow the plurality of first valves to respectively move in an axial direction, and for each of the valve spaces, a differential pressure space is respectively provided at one side thereof facing a second surface of the plurality of first valves, and the fifth flow path is branched to both sides at the middle portion thereof so as to communicate with the plurality of differential pressure spaces.

* * * * *